US007400098B2

(12) United States Patent
Ng et al.

(10) Patent No.: US 7,400,098 B2
(45) Date of Patent: Jul. 15, 2008

(54) METHOD AND APPARATUS FOR APPLYING ADAPTIVE PRECHARGE TO AN ELECTROLUMINESCENCE DISPLAY

(75) Inventors: Chung Yee Ricky Ng, Ma On Shan (HK); Stephen Wai-Yan Lai, Chandler, AZ (US); Wai Yu Felix Wong, Kowloon (HK); Cheung Fai Lee, Shatin (HK)

(73) Assignee: Solomon Systech Limited, Pak Shek Kok, NT (HK)

( * ) Notice: Subject to any disclaimer, the term of this patent is extended or adjusted under 35 U.S.C. 154(b) by 0 days.

(21) Appl. No.: 10/747,224

(22) Filed: Dec. 30, 2003

(65) Prior Publication Data

US 2005/0146281 A1 Jul. 7, 2005

(51) Int. Cl.
*G09G 3/10* (2006.01)

(52) U.S. Cl. ..... 315/169.3; 345/76

(58) Field of Classification Search ..... 315/167, 315/169.1–169.4; 345/55–62, 76–84; 702/102
See application file for complete search history.

(56) References Cited

U.S. PATENT DOCUMENTS

| | | | | |
|---|---|---|---|---|
| 6,229,508 | B1 * | 5/2001 | Kane | 345/82 |
| 6,594,606 | B2 * | 7/2003 | Everitt | 345/55 |
| 6,650,308 | B2 * | 11/2003 | Kawashima | 345/76 |
| 6,894,436 | B2 * | 5/2005 | Togashi et al. | 315/169.4 |
| 7,064,733 | B2 * | 6/2006 | Cok et al. | 345/76 |

* cited by examiner

*Primary Examiner*—Wilson Lee
(74) *Attorney, Agent, or Firm*—Bingham McCutchen LLP

(57) ABSTRACT

According to the present invention, a display driver includes a voltage and current source that drive pixels and compensate for parasitic voltage to produce row pixels having intensities that are relatively uncorrelated to the number of "ON" pixels in a given row. The voltage source that provides the precharge for each pixel includes a constant value and a compensation voltage determined based on the number of "ON" pixels in each row. The compensation voltage is also determined based on the characteristics of the diodes associated with each pixel and the resistance associated the common ground of each row.

14 Claims, 4 Drawing Sheets

METHOD AND APPARATUS FOR APPLYING ADAPTIVE PRECHARGE TO AN ELECTROLUMINESCENCE DISPLAY

FIELD OF THE INVENTION

The present invention relates generally to electroluminescence display technology and, more particularly, to a system and method for applying adaptive pre-charge to electroluminescence display matrices to compensate for cross-talk.

BACKGROUND OF THE INVENTION

Electroluminescence displays are driven by current and/or voltage circuits. An example of a voltage driven display is a liquid crystal display. An example of a current driven display is an organic light emitting display (OLED). Current driven display devices, like most displays, are configured in matrices of pixels that cover a display area. The matrix has rows and columns of pixels, where each pixel in the matrix may be turned on or off to produce patterns of light that constitute the display. Each pixel may constitute one or more diodes that each emits light having a distinct color. With three different diodes having distinct colors, most colors can be reproduced.

There are several problems associated with driving current driven displays which affects the quality of the image that the display produces. One of the problems is how to drive the matrix fast enough to turn pixels on and overcome capacitance of each pixel. Another problem is how to drive the matrix in way that produces pixels having brightness that are uncorrelated with the number of pixels that are "ON" in a given row of the matrix. A phenomenon called cross-talk relates to the effect that ON pixels within a row have on other pixels in the row. Unless corrected, there is a tendency for pixels in a given row to dim as the number of ON pixels increases.

One solution to driving the matrix of pixels fast enough is to use a voltage source in addition to a current source to pre-charge each pixel. The voltage source charges the pixel capacitance of each "ON" pixel. Then, the current source drives each pixel diode after the pre-charge cycle is complete. This solution has the advantage of shortening the time it takes to overcome the capacitance of each "ON" pixel and causes most of the current from the current source to drive the "ON" pixel diodes.

A problem remains, however, because the current from each "ON" pixel empties into a common ground. The common ground has a characteristic resistance associated with it that produces a parasitic voltage as a result of the current from the "ON" pixels. The parasitic voltage is subtracted from the pre-charge voltage and reduces the efficacy of the pre-charge voltage. Moreover, the parasitic voltage increases with each additional pixel that is turned "ON" in a given row. Thus, the quality of the display suffers and pixels appear dimmer as the number of "ON" pixels in a row increases.

Accordingly, there is a need for new technique for pre-charging current driven electroluminescent display pixels that produces ON pixel intensities that are relatively independent of the number of ON pixels in a given row. There is a further need for a technique for combating parasitic voltage induced on common ground lines within matrices of pixels. There is still a further need for display driver that compensates for parasitic voltage and that may be used to drive a range of display devices, each having its own current and parasitic voltage peculiarities.

SUMMARY OF THE PRESENT INVENTION

According to the present invention, a display driver includes a voltage and current source that drive pixels and compensate for parasitic voltage to produce row pixels having intensities that are relatively uncorrelated to the number of "ON" pixels in a given row. The voltage source that provides the pre-charge for each pixel includes a constant value and a compensation voltage determined based on the number of "ON" pixels in each row. The compensation voltage is also determined based on the characteristics of the diodes associated with each pixel and the resistance associated the common ground of each row.

According to an embodiment of the invention, an apparatus drives an electroluninescence matrix and includes at least one current source and a variable pre-charge voltage source. The current sources drive at least one corresponding matrix element when that element is ON. The variable pre-charge voltage source delivers a pre-charge voltage across the at least one matrix element when that element is "ON." The amount of the pre-charge is determined based on the number of ON matrix elements. The pre-charge voltage may also be determined based on a characteristic of the electroluminescence matrix. The matrix elements may include organic light emitting diodes and may include three different color producing diodes. Where there are multiple color diodes present, there may be additional voltage variable sources, each producing a voltage corresponding to a respective color diode based on the number of ON diodes of that color and a characteristic of diodes of that color.

According to another embodiment of the present invention, a method of driving an electroluminescence matrix includes driving at least one matrix element and delivering a pre-charge voltage across the corresponding matrix element(s) when the element(s) are "ON." The pre-charge voltage is determined based on the number of ON matrix elements in a row. The pre-charge voltage may also be determined based on a characteristic of the electroluminescence matrix.

BRIEF DESCRIPTION OF THE FIGURES

The above described features and advantages of the present invention will be more fully appreciated with reference to the appended figures and detailed description, in which.

DETAILED DESCRIPTION

According to the present invention, a display driver includes a voltage and current source that drive pixels and compensate for parasitic voltage to produce row pixels having intensities that are relatively uncorrelated to the number of "ON" pixels in a given row. The voltage source that provides the pre-charge for each pixel includes a constant value and a compensation voltage determined based on the number of "ON" pixels in each row. The compensation voltage is also determined based on the characteristics of the diodes associated with each pixel and the resistance associated the common ground of each row.

Figure 1:
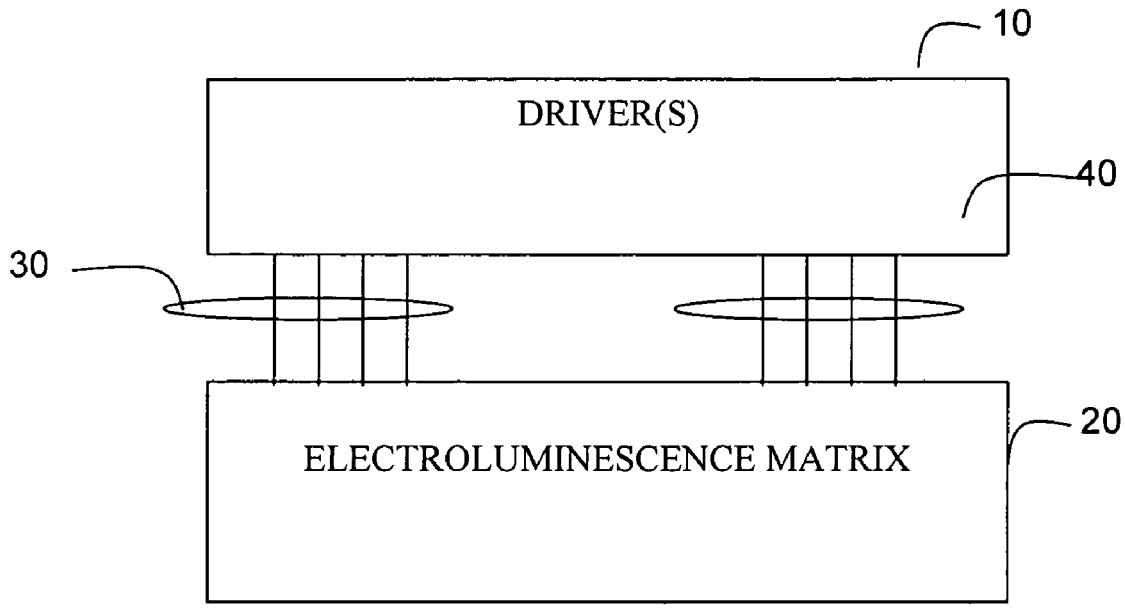
FIG. 1 depicts a display driver in operative engagement with an electroluminescence display according to an embodiment of the present invention.

FIG. 1 depicts an electroluminesence display system that includes an electroluminescence matrix 20 and one or more drivers 10. The electroluminescence matrix according to an embodiment of the present invention includes current driven light emitting elements that are arranged in rows and columns. The light emitting elements may include light emitting diodes and the particular variety of light emitting diodes known as organic light emitting diodes ("OLEDs"). Each row and column includes multiple light emitting elements that may be individually turned ON or OFF. All of the elements of the electroluminesence matrix, however, are not driven simultaneously to the ON or OFF state to create the display. Rather, the electroluminescense matrix is configured so that each row is scanned one at a time.

During a row scan, the active row is driven by the driver(s) 10. Each driver drives a corresponding matrix element in the row to either an ON or an OFF state based on data from, for example, a display buffer. The ON matrix elements in each row emit light during the scan cycle and are illuminated again in subsequent scan cycles at a particular frequency and thus have the appearance of being continually ON, even though they are not. The OFF matrix elements are not powered and thus appear dark. For color displays, there are generally three matrix elements, each emitting a different color of light at each pixel location, although there may be more or fewer colors. An embodiment of driving the electroluminescence matrix is described in more detail below.

Figure 2:
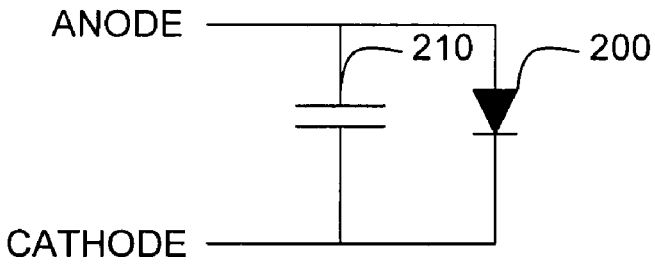
FIG. 2 depicts an electrical model of a matrix element of an electroluminescence display.

FIG. 2 depicts an electrical model of a pixel of a current driven matrix element forming a pixel. The element may be, but is not limited to, an OLED device. The matrix element includes a diode 200 and a parasitic capacitance 210 associated with the diode. The pixel emits light as current passes through the diode, which occurs when the voltage across the diode exceeds its threshold voltage. To drive the matrix element to turn it on, current from a current source is used to turn ON the diode. A problem, however, is that the current is initially diverted from the diode to the parasitic capacitance 210 because as the voltage across the diode increases toward the threshold voltage of the diode, current is drawn by the capacitance 210. This introduces a delay in turning ON the matrix element and therefore the pixel because the diode does not emit light until its threshold voltage is exceeded. When the capacitance 210 is large, diodes being driven to the ON state may remain OFF for a significant period of the time devoted to matrix row scanning. In this case, the pixel corresponding to the matrix element appears dim and brightness is difficult to control.

To overcome the problem of delay in turning ON diodes due to parasitic capacitance, the parasitic capacitance may be pre-charged to a predetermined voltage prior to driving the diode with current to turn it ON. Thus, the driver 10 selected to drive the matrix may incorporate one or more (depending on the number of colors in the display) voltage sources to pre-charge all of the ON diodes in the row being scanned and current sources to deliver current to turn ON each active diode in the row being scanned. The strength of the voltage pre-charge is a matter of design choice and depends upon the characteristics of the particular matrix being driven. In general, a voltage tolerance of 100 mV on the final pre-charge value is appropriate to achieve a high-quality display. The need for cross-talk compensation becomes particularly apparent when considering the electrical properties of the entire matrix, as shown in FIG. 3.

Figure 3:
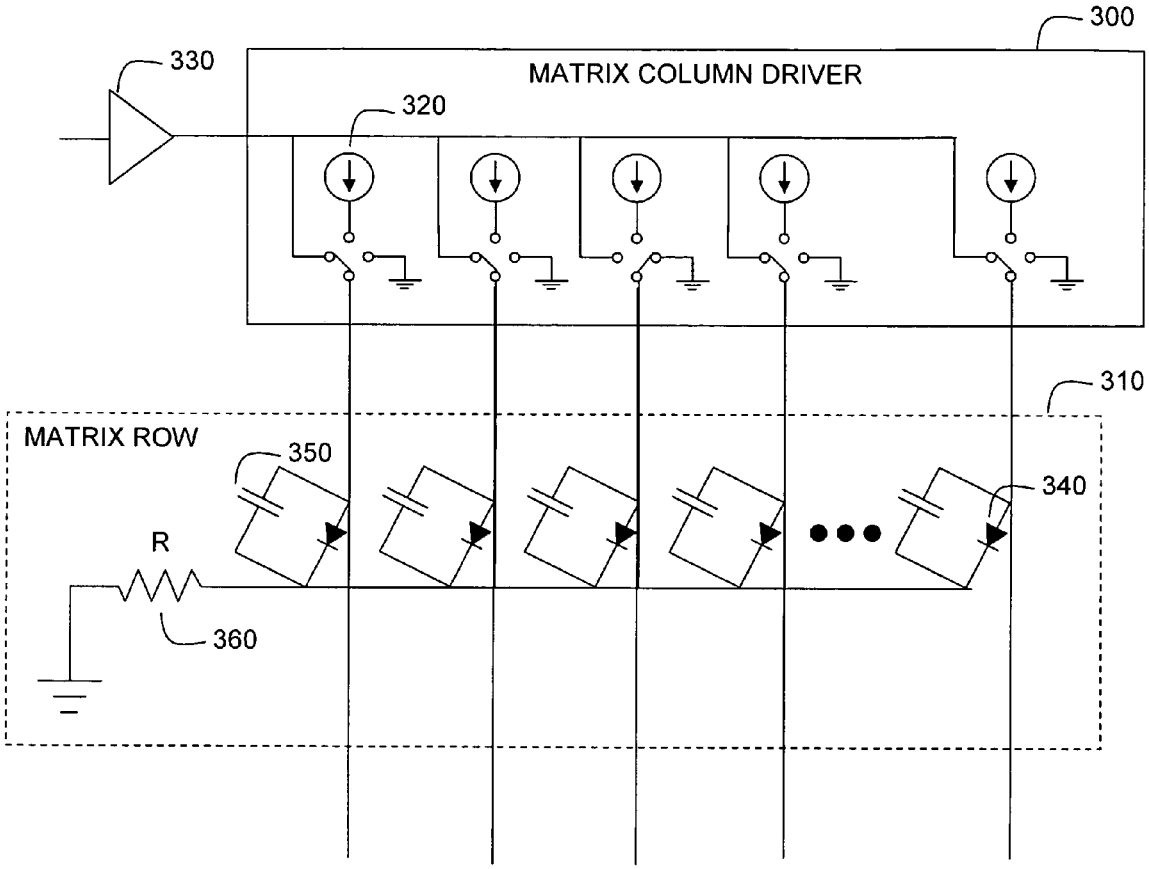
FIG. 3 depicts a display driver with a pre-charge voltage driver in operative engagement with an electroluminescence display according to an embodiment of the present invention.

FIG. 3 depicts a matrix of elements 310 being driven by a driver 300. The driver 300 includes current sources 320 coupled to each column of the matrix and a voltage source 330. The current sources 320 and the voltage source 330 are coupled to the conductive path associated with each column through switches associated with each column. The switches are set to the ON and OFF state based on display data, generally from a display buffer. In the ON state, the switches are coupled to the output of the voltage source at the beginning of a row scanning cycle. After the pre-charge cycle is over, the switches for each ON pixel connect the respective current source to the respective conductive path of the column. These two steps first cause the parasitic capacitance to be charged and then cause the current source to send current through the diode, with its associated parasitic capacitance to turn ON the diode.

The current from the voltage source and the current sources enter each respective matrix element at the anode shown in FIG. 2. The cathode of each matrix element is connected to a row conductive path which in turn feeds through one or more devices to ground. The devices may include a common driver device and a common electrode of the matrix. The devices have associated with them a parasitic resistance shown in FIG. 3 as Resistance 360. The devices, represented electrically as resistance 360, are turned on one row at a time to implement row scanning. Thus, the voltage and current placed on the conductive paths of the columns are applied across and to the capacitance and diode of the row actively being scanned.

A consequence of having a resistance 360 on the row conductive path is that a voltage is developed across the resistance 360 which increases with each additional diode that is turned ON. As the current flowing through the column conductive paths increases, so does the voltage. For this reason, rows that have many pixels turned ON appear more dim than rows with fewer pixels turned ON. This phenomenon is known as crosstalk. According to an embodiment of the present invention, the voltage source that provides pre-charge for the matrix may vary the amount of pre-charge voltage it delivers based on the number of ON matrix elements in each row. In addition, the voltage source may vary the amount of pre-charge voltage that it applies based on the amount of current dissipated by each diode in the ON state, which may in turn depending on the current dissipating characteristics of each different type of diode. In addition, the parasitic resistance 360 is another factor that may be used to determine the pre-charge voltage.

Figure 4A:
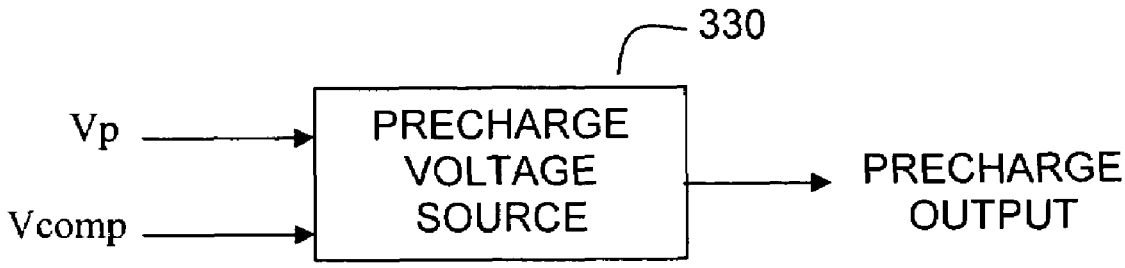
FIG. 4A depicts a variable pre-charge voltage source according to an embodiment of the present invention.

FIG. 4A depicts a variable voltage source for providing a pre-charge voltage to an electroluminescence matrix according to an embodiment of the present invention. The voltage source is adjustable and allows the pre-charge voltage to be set based on a variety of factors and real-time conditions. Referring to FIG. 4A, the voltage source includes inputs corresponding to the number of ON pixels for diode, a scaling factor K and a pre-charge voltage Vp. The number of pixels ON in a given row may be expressed as 0 to N where there are N pixels in the row or M where M=0 to 5 as a acceptable approximate or another convenient value. The inputs may be digital values or analog values. Vp is a pre-charge value which may be set and adjusted to achieve optimum performance of the matrix under a variety of conditions. Its value reflects the pre-charge voltage when one or a few pixels are ON in a given row. K is a scaling value that is determined based on the current of the diode implemented as a matrix element and the parasitic resistance 360.

Figure 4B:
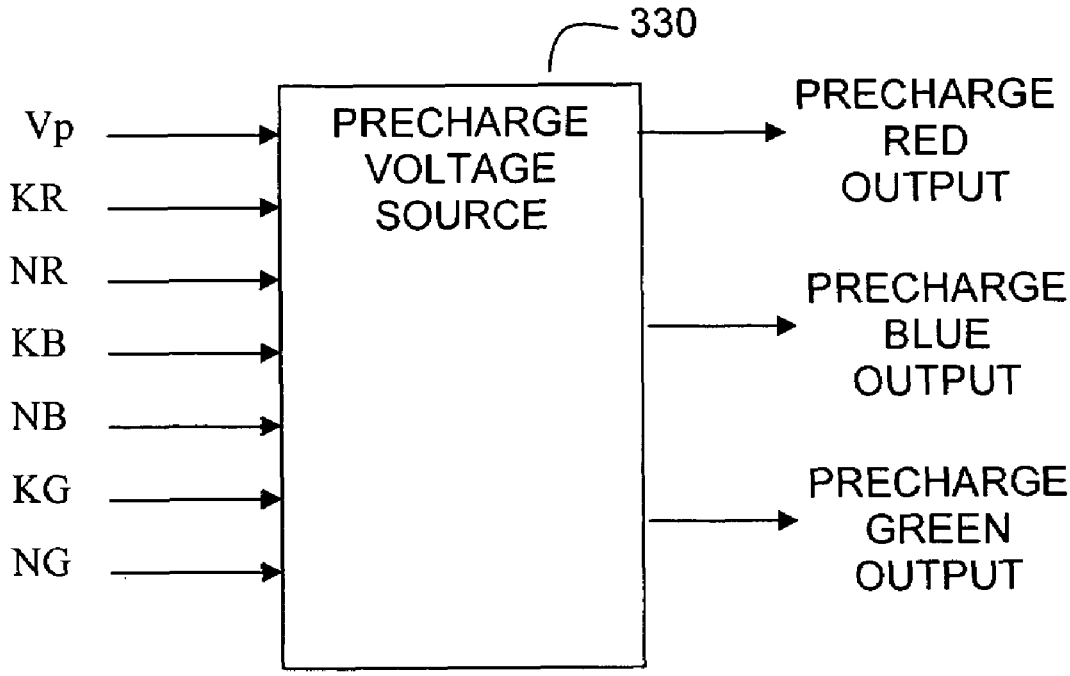
FIG. 4B depicts a variable pre-charge voltage source according to an embodiment of the present invention for driving a color display.
Figure 5:
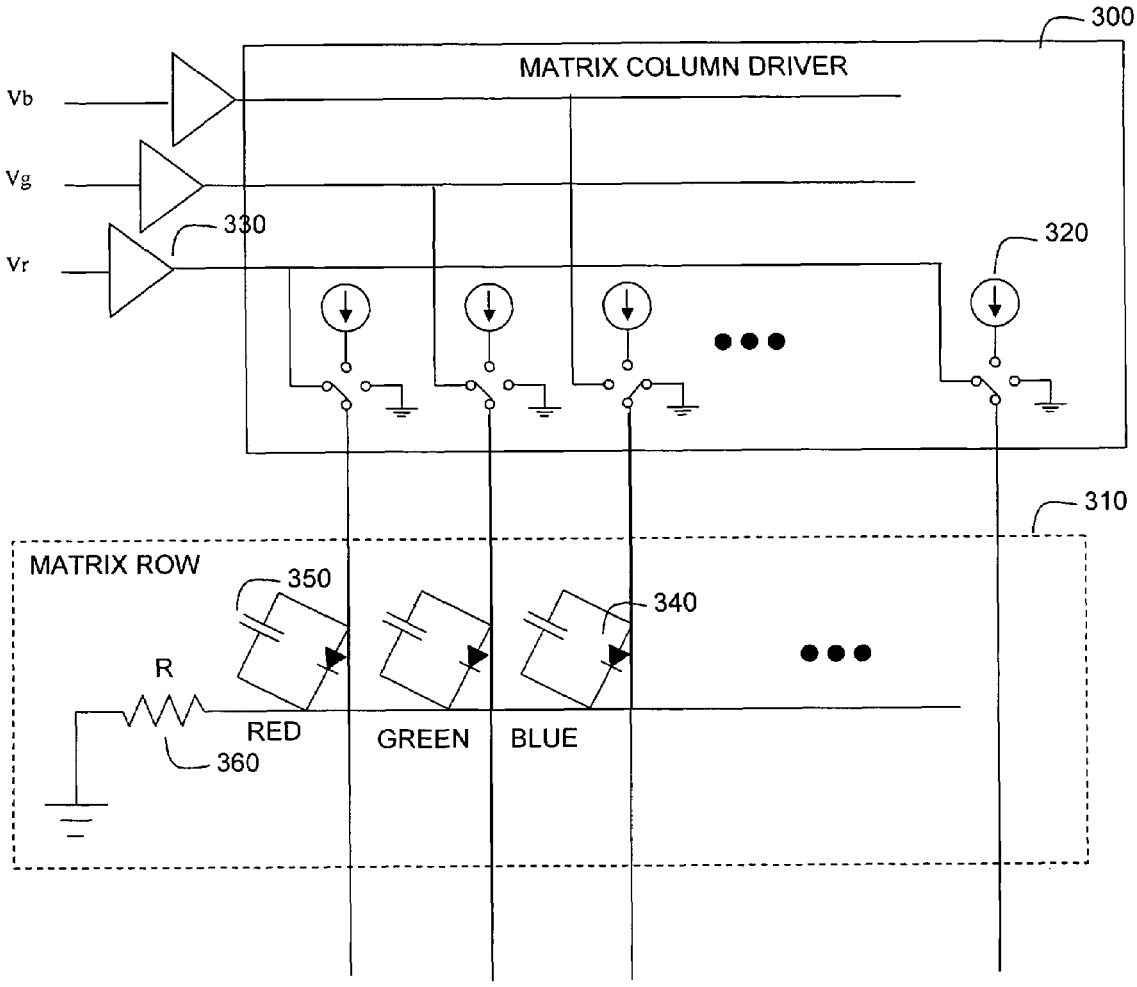
FIG. 5 depicts a display driver with a pre-charge voltage driver in operative engagement with an electroluminescence display according to an embodiment of the present invention for driving a color display.

The values M or N and K are used to determine a compensation voltage Vc that, when added to Vp produces a consistent pre-charge voltage across the diode. Thus, Vprecharge=Vp+Vc. Vc is generally equal to the current flowing through all of the ON diodes multiplied by the parasitic resistance 360. The variable pre-charge voltage source may be implemented using a variety of analog and/or digital configurations. In general, the pre-charge voltage source 330 generates an output voltage based on K, M or N and Vp. K and Vp may be values stored in a register in the driver that can be changed to achieve desired matrix drive characteristics for a particular matrix. The values of M or N may be determined dynamically in real time during a row scan based on data from the display buffer used as an input to the driver. FIG. 4B depicts an alternate embodiment of the pre-charge voltage source 330 configured to drive a multi-color display matrix. The pre-charge voltage source 330 accepts input values Kr, Kg, Kb corresponding to the current dissipation characteristics of each diode and the parasitic resistance 360. It also accepts values corresponding to the number of ON diodes of each color corresponding to either a N or an M value as described above. In addition, there is a baseline pre-charge voltage Vpr, Vpg, Vpb for each different color producing diode. Based on these values, an overall compensation voltage value is determined Vc as before which represents Kr*Nr+Kg*Ng+Kb*Nb. Each of these terms represents a scaling factor for each color diode times the number of ON diodes of that type resulting in a voltage Vc across the parasitic resistance. The Vc value is added to the pre-charge voltage for each color to produce the pre-charge output voltages for each color. In this manner, the pre-charge voltage source produces an output voltage for each different color that is compensated in real time by the voltage induced across the resistance 360. A color matrix is depicted in FIG. 5.

While particular embodiments of the invention have been described herein, one of ordinary skill in the art will appreciate that changes may be made to those embodiments without departing from the spirit and scope of the invention.

What is claimed is:

1. An apparatus for driving an electroluminescence matrix, comprising:

at least one current source for driving at least one corresponding matrix element when that element is ON; and a variable voltage source for delivering a pre-charge voltage across the at least one matrix element when that element is "ON"; and an adaptive pre-charge scheme based on determining the pre-charge voltage for a scan cycle using the image data of the scan cycle, thereby optimizing the pre-charge voltage for the scan cycle by taking into account:

(a) the actual number of ON matrix elements determined from the image data of the scan cycle; and (b) parameters of the electroluminescence matrix characteristics.

2. The apparatus according to claim 1, wherein the pre-charge voltage is determined based on the number of ON matrix elements in a row.

3. The apparatus according to claim 1, wherein the pre-charge voltage is determined by the summation of voltages Vp and Vc wherein Vp is the required pre-charge voltage when one or a few pixels are ON, and VP value is obtained by external equipment, and wherein Vc is the compensation voltage, and Vc is linearly proportional to the number of ON matrix elements.

4. The apparatus according to claim 1, wherein the matrix elements are organic light emitting diodes.

5. The apparatus according to claim 4, wherein each pixel location in matrix includes three diodes, each of the three diodes emitting a different color of light.

6. The apparatus according to claim 5, further comprising two additional variable voltage sources, wherein each of the variable voltage sources is coupled to diodes of a respective one of the three colors.

7. The apparatus according to claim 6, wherein the pre-charge voltage of each of the variable voltage sources is determined based on the number of "ON" diodes of each respective color.

8. A method of driving an electroluminescence matrix, comprising:

driving at least one corresponding matrix element when that element is ON; and delivering a pre-charge voltage across the at least one matrix element when that element is "ON"; and determining the pre-charge voltage adaptively for a scan cycle using the image data of the scan cycle, thereby optimizing the pre-charge voltage for the scan cycle by taking into account:

(a) the actual number of ON matrix elements determined from the image data of the scan cycle; and (b) parameters of the electroluminescence matrix characteristics.

9. The method according to claim 8, wherein the pre-charge voltage is determined based on the number of ON matrix elements in a row.

10. The method according to claim 8, wherein the pre-charge voltage is determined by the summation of voltages Vp and Vc wherein Vp is the required pre-charge voltage when one or a few pixels are ON, and VP value is obtained by external equipment, and wherein Vc is the compensation voltage, and Vc is linearly proportional to the number of ON matrix elements.

11. The method according to claim 8, wherein the matrix elements are organic light emitting diodes.

12. The method according to claim 11, wherein each pixel location in matrix includes three diodes, each of the three diodes emitting a different color of light.

13. The method according to claim 12, further comprising delivering two additional precharge voltages, wherein each of the precharge voltages is coupled to a diode of a respective one of the three colors.

14. The apparatus according to claim 13, wherein each pre-charge voltage is determined based on the number of "ON" diodes of each respective color.

* * * * *